US007017714B2

(12) United States Patent
Fujita et al.

(10) Patent No.: US 7,017,714 B2
(45) Date of Patent: Mar. 28, 2006

(54) DOUBLE DECK ELEVATOR

(75) Inventors: Yoshiaki Fujita, Fuchu (JP); Naoki Kondo, Kawasaki (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 10/507,377

(22) PCT Filed: Mar. 18, 2003

(86) PCT No.: PCT/JP03/03279

§ 371 (c)(1),
(2), (4) Date: Sep. 21, 2004

(87) PCT Pub. No.: WO03/080492

PCT Pub. Date: Oct. 2, 2003

(65) Prior Publication Data

US 2005/0167207 A1 Aug. 4, 2005

(30) Foreign Application Priority Data

Mar. 22, 2002 (JP) ..... 2002-080982

(51) Int. Cl.
*B66B 9/02* (2006.01)
*B66B 3/00* (2006.01)
*B66B 11/02* (2006.01)

(52) U.S. Cl. ..... 187/267; 187/391; 187/392; 187/393; 187/401

(58) Field of Classification Search ..... 187/267, 187/391, 392, 393, 401
See application file for complete search history.

(56) References Cited

U.S. PATENT DOCUMENTS

| | | | | |
|---|---|---|---|---|
| 11,251 | A * | 7/1854 | Young | 404/28 |
| 2,319,126 | A * | 5/1943 | Grote | 187/274 |
| 5,306,879 | A * | 4/1994 | Pearson | 187/392 |
| 5,907,136 | A * | 5/1999 | Hongo et al. | 187/277 |
| 5,960,910 | A * | 10/1999 | Traktovenko | 187/401 |
| 6,161,652 | A * | 12/2000 | Kostka et al. | 187/291 |
| 6,450,299 | B1 * | 9/2002 | Lysaght | 187/393 |
| 6,615,952 | B1 * | 9/2003 | Itoh et al. | 187/249 |
| 6,786,305 | B1 * | 9/2004 | Kamimura et al. | 187/401 |
| 6,802,396 | B1 * | 10/2004 | Naitoh | 187/401 |
| 6,857,507 | B1 * | 2/2005 | Gallati et al. | 187/284 |

FOREIGN PATENT DOCUMENTS

FR 2683012 A1 * 4/1993

(Continued)

*Primary Examiner*—Kathy Matecki
*Assistant Examiner*—Eric E. Pico
(74) *Attorney, Agent, or Firm*—Oblon, Spivak, McClelland, Maier & Neustadt, P.C.

(57) ABSTRACT

There is provided a double-deck elevator which does not cause any impacts or vibrations on each cage when adjusting the spacing in the vertical direction between upper and lower cages. Loads on an upper support beam from right and left support arms for hoisting and supporting the upper cage are measured by right and left upper measuring units. Similarly, loads on a lower support beam from right and left support arms for hoisting and supporting the lower cage are measured by right and left lower measuring units. Because the magnitude of the loads on the right and left screw shafts can be obtained correctly, any impacts or vibrations caused on each cage can be prevented when adjusting the spacing in the vertical direction by correctly controlling the drive torque output from right and left drive motors.

10 Claims, 8 Drawing Sheets

FOREIGN PATENT DOCUMENTS

| | | | |
|---|---|---|---|
| JP | 113162/1975 | | 9/1975 |
| JP | 11-314858 | | 11/1999 |
| JP | 11314858 | A * | 11/1999 |
| JP | 2000-344448 | | 12/2000 |
| JP | 2000344448 | A * | 12/2000 |
| JP | 2001-322771 | | 11/2001 |
| WO | WO 9809906 | A1 * | 3/1998 |

* cited by examiner

DOUBLE DECK ELEVATOR

BACKGROUND OF THE INVENTION

1. Field of the Invention

The present invention relates to a double-deck elevator capable of adjusting a spacing in the vertical direction between upper and lower cages, and more specifically, it relates to a double-deck elevator improved so as to adjust the spacing in the vertical direction without causing any impacts or vibrations to each cage.

2. Description of the Related Art

Recently, double-deck elevators having upper and lower cages which respectively arrive on two floors, upper and lower floors, of a building in order to increase the elevator handling capacity in the vertical direction in high-rise buildings have attracted attention.

In many recent super high-rise buildings, the design is improved by providing an open-ceiling entrance hall or lobby on a first floor, where height from the first floor to the ceiling is set to be larger than that between other floors.

A double-deck elevator capable of changing the spacing in the vertical direction between upper and lower cages according to the spacing in the vertical direction between floors has been proposed.

For example, in a conventional double-deck elevator 1 shown in FIG. 8, upper and lower cages 3 and 4 are supported in a vertically movable manner by a cage frame 2 which is hoisted by a main rope R.

Further, right and left screw shafts 5L and 5R extending in the vertical direction are rotatably supported by right and left vertical frames 2*a* and 2*b* constituting the cage frame 2.

Drive motors 6R and 6L for rotating the right and left screw shafts 5L and 5R in the forward and reverse directions are disposed on an upper beam 2*c* constituting the cage frame 2.

In addition, a screw nut 7*a* of a support frame 7 to support the upper cage 3 is screwed onto an upper screw part 5*a* of the right and left screw shafts 5L and 5R.

In addition, a screw nut 8*a* of a support frame 8 to support the lower cage 4 is engaged onto a lower screw part 5*b* of the right and left screw shafts 5L and 5R.

The upper screw part 5*a* and the lower screw part 5*b* of the right and left screw shafts 5L and 5R are threaded in the directions opposite to each other.

Accordingly, when the right and left screw shafts 5L and 5R are driven and respectively rotated in the forward direction by using the right and left drive motors 6R and 6L, the spacing in the vertical direction between the upper and lower cages 3 and 4 can be reduced.

On the other hand, when the right and left screw shafts 5L and 5R are respectively driven and rotated in the directions opposite to each other, the spacing in the vertical direction between the upper and lower cages 3 and 4 can be increased.

In the conventional double-deck elevator 1 shown in FIG. 8, when the spacing in the vertical direction between the upper and lower cages 3 and 4 is not being adjusted, brakes are applied respectively so that the right and left screw shafts 5L and 5R are not rotated, and the spacing in the vertical direction between the upper and lower cages 3 and 4 is not changed.

Accordingly, when adjusting the spacing in the vertical direction between the upper and lower cages 3 and 4, the brakes applied to the right and left screw shafts 5L and 5R, respectively, are released so that the right and left screw shafts 5L and 5R can be freely rotated.

If the number of passengers riding in the lower cage 4 is larger than the number of passengers riding in the upper cage 3, the lower cage 4 becomes heavier than the upper cage 3.

Thus, the biasing force required to rotate the right and left screw shafts 5L and 5R in the reverse direction to move the weight of the lower cage 4 becomes larger than the biasing force required to rotate the right and left screw shafts 5L and 5R in the forward direction to move the weight of the upper cage 3.

Therefore, as soon as the brakes applied to the right and left screw shafts 5L and 5R are released so as to adjust the spacing in the vertical direction between the cages 3 and 4, the right and left screw shaft 5R and 5L are rotated in the directions opposite to each other, impacts and vibrations are caused in the cages 3 and 4, and the passengers in the cages 3 and 4 experience unpleasantness.

Accordingly, a technology has been proposed in which no impacts or vibrations are caused in the cages 3 and 4 even when the brakes applied to the right and left screw shafts 5L and 5R are released when adjusting the spacing in the vertical direction between the cages 3 and 4 by respectively measuring the weight of the cages 3 and 4, and performing control so that a drive torque with a magnitude and direction according to the difference in weight between the cages 3 and 4 is output in advance by the drive motors 6R and 6L.

However, in such a conventional technology, vibration isolating rubber members for elastically supporting the cages 3 and 4 with respect to the support frames 7 and 8 are disposed at four corners below the cages 3 and 4, and the displacement in the vertical direction at the center position of a floor of each cage is measured by corresponding sensors so as to measure the displacement in the vertical direction of the cages 3 and 4 with respect to the support frames 7 and 8.

The weight of the cages 3 and 4 is calculated based on the displacement in the vertical direction of the floor of each cage obtained from each sensor and the elastic constant of the vibration isolating rubber members.

However, the displacement in the vertical direction at the center position of the floors of the cages 3 and 4 does not always necessarily indicate the displacement in the vertical direction of the cages 3 and 4 correctly.

For example, when passengers enter unevenly on the left side of the cage 3, the displacement in the vertical direction on the left side of the cage 3 is large while the displacement in the vertical direction on the right side of the cage 3 is small.

In addition, the total displacement in the vertical direction of the cages 3 and 4 and the displacement in the vertical direction at the center position of a cage floor may be different from each other according to the position of reinforcing members constituting the cage floor.

SUMMARY OF THE INVENTION

Accordingly, it is an object of the present invention to provide a double-deck elevator which solves the problems in the above conventional technology, and causes no impacts or vibrations in cages when adjusting the spacing in the vertical direction between upper and lower cages by correctly controlling the operation of screw shaft driving units based on accurate measurement of the weight of the upper and lower cages.

According to a first aspect of the invention, a double-deck elevator capable of adjusting the spacing in the vertical direction between upper and lower cages provided on a cage frame in a vertically movable manner comprises: a screw shaft rotatably supported by the cage frame and extending in the vertical direction; screw shaft driving units for rotating the screw shaft in the forward and reverse directions; a controller for controlling the operation of the screw shaft driving units; an upper supporting member which is engaged with an upper screw part of the screw shaft and vertically moved by the rotation of the screw shaft, and which hoists and supports the upper cage via one upper hoist-and-support part disposed on an upper part of the upper cage; a lower supporting member which is engaged with a lower screw part threaded in a direction opposite to that of the upper screw part of the screw shaft and vertically moved by the rotation of the screw shaft, and which hoists and supports the lower cage via one lower hoist-and-support part disposed on an upper part of the lower cage; an upper measuring unit which measures a load on the upper supporting member from the upper hoist-and-support part; and a lower measuring unit which measures a load on the lower supporting member from the lower hoist-and-support part.

The controller controls the operation of the screw shaft driving units based on the load value obtained by the upper measuring unit and the load value obtained from the lower measuring unit before adjusting the spacing in the vertical direction between the upper cage and the lower cage so that the screw shaft driving units output a drive torque with a direction and magnitude for canceling the rotational biasing force applied to the screw shaft attributable to the difference in weight between the upper cage and the lower cage.

In other words, in the double-deck elevator according to the first aspect of the present invention, the upper supporting member and the lower supporting member can be constituted for cantilever beams with each base end thereof supported by the screw shaft.

The upper supporting member hoists and supports the upper cage via one upper hoist-and-support part disposed on an upper part of the upper cage, preferably, at a center of the upper part thereof, and the load on the upper supporting member from the upper hoist-and-support part is measured by the upper measuring unit.

The lower supporting member hoists and supports the lower cage via one lower hoist-and-support part disposed on an upper part of the lower cage, preferably, at a center of the upper part thereof, and the load on the lower supporting member from the lower hoist-and-support part is measured by the lower measuring unit.

Accordingly, the total weight of the upper cage and the total weight of the lower cage can be exclusively measured by one upper hoist-and-support part and one lower hoist-and-support part, respectively, and the weight of the upper cage and the lower cage can be measured correctly.

The controller controls the operation of the screw shaft driving units based on the weight of the upper and lower cages measured correctly as described above before adjusting the spacing in the vertical direction between the upper cage and the lower cage so that the screw shaft driving units output a drive torque with a direction and magnitude for canceling the rotational biasing force applied to the screw shaft attributable to the difference in weight between the upper cage and the lower cage.

Therefore, in the double-deck elevator according to the first aspect of the present invention, the screw shaft is not rotated attributable to the difference in weight between the upper cage and the lower cage even when a brake to stop the rotation of the screw shaft is released when adjusting the spacing in the vertical direction between the upper cage and the lower cage, and any impacts or vibrations are not caused in each cage when adjusting the spacing in the vertical direction between the upper cage and the lower cage.

According to a second aspect of the present invention for solving the above problems, a double-deck elevator capable of adjusting the spacing in the vertical direction between the upper cage and the lower cage which are provided on the cage frame in a vertically movable manner comprises: a screw shaft rotatably supported on right and left sides of the cage frame and extending in the vertical direction; right and left screw shaft driving units for rotating the right and left screw shafts in the forward and reverse directions, respectively; controllers for individually controlling the operation of the right and left screw shaft driving units; an upper supporting member, which extends in the right-and-left direction above the upper cage, and is engaged with upper screw parts of the right and left screw shafts and vertically moved by the screw shafts; a lower supporting member, which extends in the right-and-left direction above the lower cage, and is engaged with lower screw parts which are threaded in the direction opposite to that of the upper screw parts of the right and left screw shafts and vertically moved by the screw shafts; right and left upper hoist-and-support parts which are disposed on the right and left sides of the upper part of the upper cage in the vicinity of the right and left screw shafts, and engaged with the upper supporting member respectively to hoist and support the upper cage; right and left lower hoist-and-support parts which are disposed on the right and left sides of the upper part of the lower cage in the vicinity of the right and left screw shafts, and engaged with the lower supporting member respectively to hoist and support the lower cage; right and left upper measuring units for measuring the load applied to the upper supporting member from the right and left upper hoist-and-support parts; and right and left lower measuring units for measuring the load applied to the lower supporting member from the right and left lower hoist-and-support parts.

The controllers control the operation of the left screw shaft driving units based on the load value obtained from the left upper measuring unit and the load value obtained from the left lower measuring unit before adjusting the spacing in the vertical direction between the upper cage and the lower cage so that a drive torque with a direction and magnitude for canceling the rotational biasing force applied to the left screw shaft attributable to the difference between the load applied to the upper supporting member from the upper hoist-and-support part and the load applied to the lower supporting member from the left lower hoist-and-support part is output.

A pair of front and back controllers control the operation of the right screw shaft driving unit based on the load value obtained from the right upper measuring unit and the load value obtained from the right lower measuring unit so that a drive torque with a direction and magnitude for canceling the rotational biasing force applied to the right screw shaft attributable to the difference between the load on the upper supporting member from the right upper hoist-and-support part and the load on the lower supporting member from the right lower hoist-and-support part is output.

In other words, in the double-deck elevator according to the second aspect of the present invention, the upper supporting member and the lower supporting member can be constituted for cantilever beams supported by the right and left screw shafts.

The upper supporting member hoists and supports the upper cage via the upper hoist-and-support parts disposed on right and left sides of the upper part of the upper cage, and the lower supporting member hoists and supports the lower cage via the upper hoist-and-support parts disposed on the right and left sides of the upper part of the lower cage.

In this condition, the right and left upper hoist-and-support parts are disposed in the vicinity of the right and left screw shafts, respectively, and the magnitude of the load on the upper supporting member from the left upper hoist-and-support part is substantially equal to the magnitude of the load on the left screw shaft from the upper supporting member, and the magnitude of the load on the upper supporting member from the right upper hoist-and-support part is substantially equal to the magnitude of the load on the left screw shaft from the upper supporting member.

Similarly, the right and left lower hoist-and-support parts are disposed in the vicinity of the right and left screw shafts, respectively, and the magnitude of the load on the lower supporting member from the left lower hoist-and-support part is substantially equal to the magnitude of the load on the left screw shaft from the lower supporting member, and the magnitude of the load on the lower supporting member from the right lower hoist-and-support part is substantially equal to the magnitude of the load on the right screw shaft from the lower supporting member.

Accordingly, the left upper measuring unit and the left lower measuring unit can correctly measure the magnitude of the load on the left screw shaft from the upper supporting member, and the magnitude of the load on the left screw shaft from the lower supporting member.

Similarly, the -right upper measuring unit and the right lower measuring unit can correctly measure the magnitude of the load on the right screw shaft from the upper supporting member, and the magnitude of the load on the right screw shaft from the lower supporting member.

The controllers control the operation of the left screw shaft driving unit based on the load value correctly measured as described above before adjusting the spacing in the vertical direction between the upper cage and the lower cage so that the left screw shaft driving unit outputs a drive torque with a direction and magnitude for canceling the rotational biasing force applied to the left screw shaft attributable to the difference between the load on the left screw shaft from the upper supporting member and the load on the left screw shaft from the lower supporting member.

Similarly, the controllers control the operation of the right screw shaft driving unit based on the load value correctly measured as described above before adjusting the spacing in the vertical direction between the upper cage and the lower cage so that the right screw shaft driving unit outputs a drive torque with a direction and magnitude for canceling the rotational biasing force applied to the right screw shaft attributable to the difference between the load on the right screw shaft from the upper supporting member and the load on the right screw shaft from the lower supporting member.

Accordingly, in the double-deck elevator according to the second aspect of the present invention, for example, even when passengers enter unevenly on the left side of each cage, any one of the right and left screw shafts is not rotated attributable to the difference in weight between the upper cage and the lower cage when a brake to stop the rotation of the screw shafts is released when adjusting the spacing in the vertical direction between the upper cage and the lower cage, and any impacts or vibrations are caused in any cage.

According to a third aspect of the present invention, in the double-deck elevator according to the first or second aspect of the present invention, the upper measuring unit and the lower measuring unit comprise elastic bodies interposed between the upper supporting member and the upper hoist-and-support part, and between the lower supporting member and the lower hoist-and-support part, and sensors for measuring the deformation in the vertical direction of the elastic bodies.

The controllers respectively calculate the load value based on the elastic constant of the elastic bodies and the deformation obtained from the sensors.

In other words, in the double-deck elevator according to the first or second aspect of the present invention, the total weight of the upper and lower cages is applied to each supporting unit via each hoist-and-support part.

Accordingly, the deformation in the vertical direction of the elastic bodies interposed between each hoist-and-support part and each supporting unit is measured, and the load on each supporting unit from each hoist-and-support part can be calculated correctly based on the measured deformation in the vertical direction and the elastic constant of the elastic bodies.

The elastic bodies interposed between each hoist-and-support part and each supporting unit may be vibration isolating rubber members to elastically hoist each cage and improve the ride quality thereof.

The sensor for measuring the deformation in the vertical direction of the elastic bodies includes a differential transducer or a linear encoder for measuring the distance between each hoist-and-support part and each supporting unit, and an optical distance sensor using laser beam or infrared ray.

According to a fourth aspect of the present invention, in the double-deck elevator according to the third aspect of the present invention, the controllers adjust the spacing in the vertical direction between the upper cage and the lower cage based on the deformation in the vertical direction of the elastic bodies obtained from the sensors.

In other words, the controllers for controlling the operation of the screw shaft driving units control the rotational direction and the total number of rotation of the screw shafts via the screw shaft driving units, and controls the spacing in the vertical direction between the upper supporting member and the lower supporting member.

In this condition, in the double-deck elevator according to the third aspect of the present invention, the deformation in the vertical direction of each elastic body, therefore, the relative position of each cage to each supporting unit can be obtained correctly, and the spacing in the vertical direction between the upper cage and the lower cage can be adjusted more correctly.

Further, according to a fifth aspect of the present invention, in the double-deck elevator according to the first or second aspect of the present invention, the upper measuring unit and the lower measuring unit are load cells interposed between the upper supporting member and the upper hoist-and-support part, and between the lower supporting member and the lower hoist-and-support part.

In other words, in the double-deck elevator according to the first or second aspect of the present invention, the total weight of the upper and lower cages is respectively applied to each supporting unit via each hoist-and-support part.

Accordingly, the load on each supporting unit from each hoist-and-support part can be obtained correctly if a load cell is interposed between each hoist-and-support part and each supporting unit.

Still further, according to a sixth aspect of the present invention, in the double-deck elevator according to the fifth aspect of the present invention, the load cells are disposed in series with the elastic bodies between the upper supporting member and the upper hoist-and-support part, and between the lower supporting member and the lower hoist-and-support part.

In other words, if the load cell and the elastic body are interposed in series between each hoist-and-support part and each supporting unit, the load on each supporting unit from each hoist-and-support part can be obtained correctly, each cage is elastically supported, and the ride quality can be improved thereby.

DESCRIPTION OF THE PREFERRED EMBODIMENTS

Figure 1:
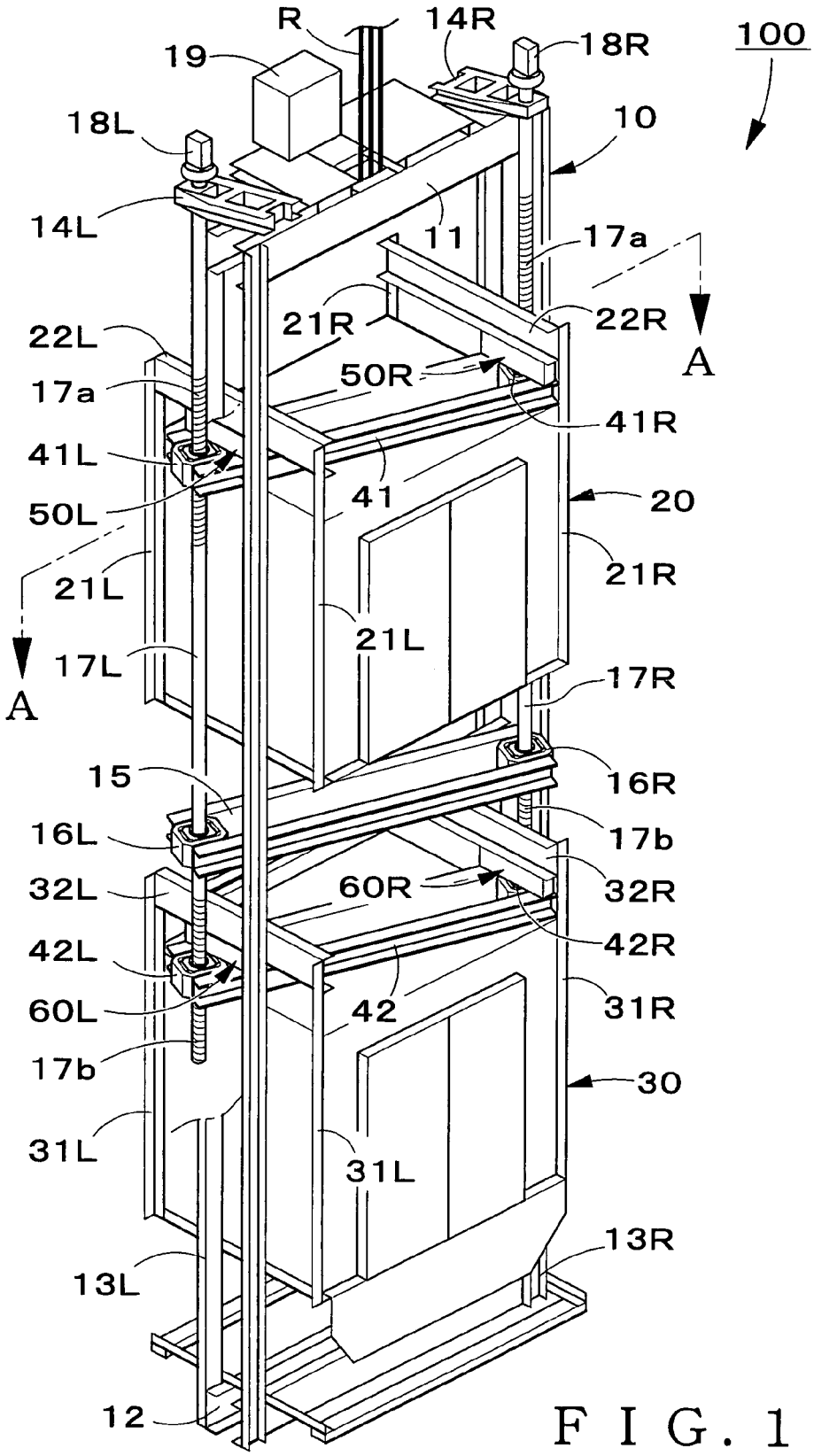
FIG. 1 is a perspective view of a double-deck elevator according to an embodiment of the present invention.

Embodiments of a double-deck elevator of the present invention will be described with reference to FIGS. 1 to 3.

In the description below, the vertical direction is defined as the perpendicular direction, the right-to-left direction is defined as the direction in which an entrance door of each cage is opened/closed, and the depth direction is defined as the direction in which passengers enter/exit each cage.

Firstly, the entire structure of a double-deck elevator 100 according to the present embodiment will be described with reference to FIGS. 1 and 2. A cage frame 10 hoisted by a main rope R has right and left vertical beams 13R and 13L extending in the vertical direction between an upper beam 11 and a lower beam 12.

In the vicinity of the right and left vertical beams 13R and 13L, right and left ball screws (screw shafts) 17R and 17L, which are rotatably supported by support arms 14R and 14L fitted to an upper beam 11 and an intermediate beam 15 horizontally extending in the right-to-left direction at a middle part in the vertical direction of the vertical beams 13R and 13L, extend in the vertical direction.

The right and left ball screws 17R and 17L are rotated in the forward and reverse direction by right and left drive motors (screw shaft driving units) 18R and 18L, which are fitted to the support arms 14R and 14L, respectively.

The threading direction of an upper screw part 17*a* provided on an upper side thereof and that of a lower screw part 17*b* provided on a lower side thereof are opposite to each other.

The operation of the right and left drive motors 18R and 18L can be individually controlled by a controller 19 which is a microcomputer.

Upper and lower cages 20 and 30 are supported by a supporting unit (not shown) in a vertically movable manner inside the cage frame 10.

The upper cage 20 comprises a pair of frame members 21L which are installed at front and back ends, on the left side in the figure and they extend in the vertical direction, and a pair of frame members 21R which are installed at front and back ends, on the right side in the figure and which extend in the vertical direction.

A left upper support arm (an upper hoist-and-support part) 22L extending in the depth direction extends over upper ends of the pair of frame members 21L.

A right upper hoist and support arm (an upper hoist-and-support part) 22R, extending in the depth direction parallel to the left upper support arm 22L, extends over upper ends of a pair of front and back frame members 21R on the right side.

Figure 2:
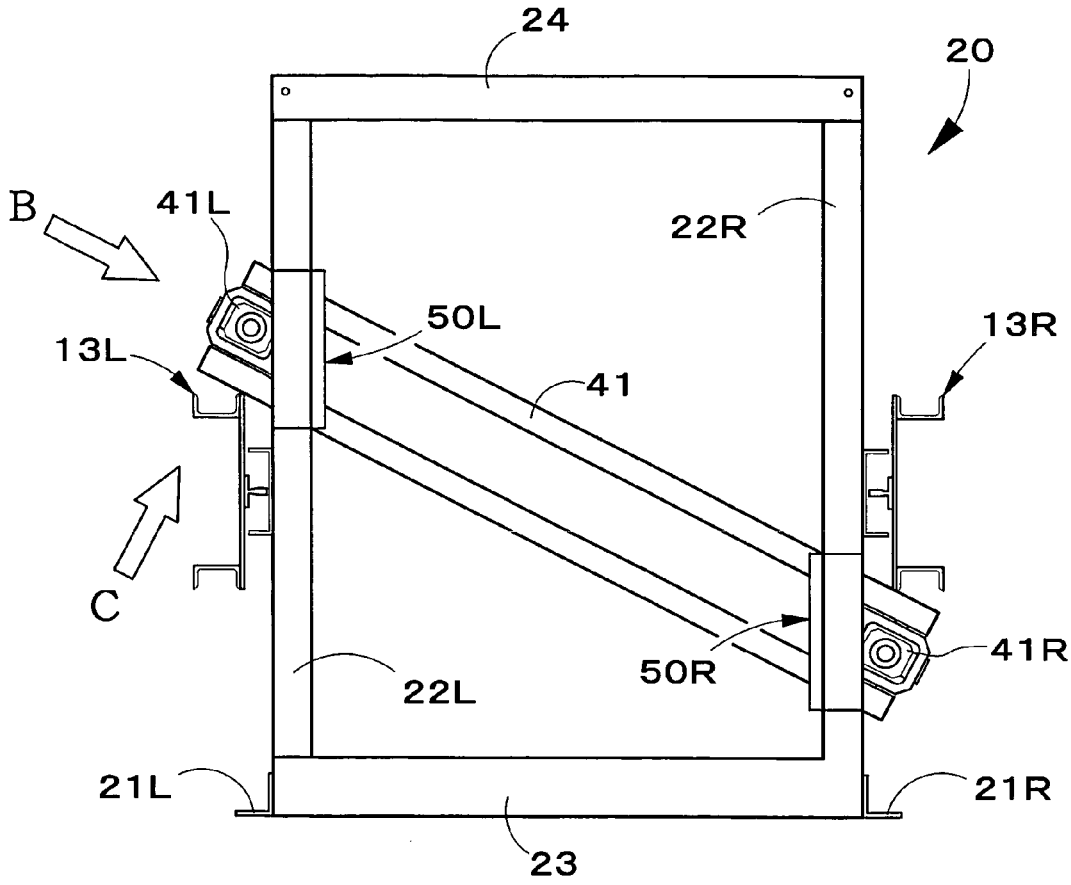
FIG. 2 is a horizontal sectional view of through the line A—A shown in FIG. 1.

The front and back ends of the right and left upper support arms 22R and 22L are connected to each other for reinforcement by a pair of front and back reinforcing members 23 and 24 extending in the right-to-left direction, as shown in FIG. 2, though they are omitted in FIG. 1.

Similarly, a lower cage 30 comprises a pair of frame members 31L which are installed at front and back ends on the left side in the figure, and they extend in the vertical direction, and a pair of frame members 31R which are installed at front and back ends on the right side in the figure and which extend in the vertical direction.

A left lower support arm (a lower hoist-and-support part) 32L extending in the depth direction extends over upper ends of the pair of front and back frame members 31L on the left side.

A right lower support arm (a lower hoist-and-support part) 32R extending in the depth direction parallel to the left lower support arm 32L extends over upper ends of the pair of front and back frame members 31R on the right side.

The front and back ends of the right and left upper support arms 32R and 32L are connected to each other for reinforcement by the pair of front and back reinforcing members extending in the right-to-left direction similarly to the upper cage 20, though they are omitted in FIG. 1.

An upper support beam (an upper supporting member) 41 extending in the right-to-left direction is disposed above the upper cage 20 and below the right and left upper support arms 22R and 22L.

Right and left screw nuts 41R and 41L fitted to right and left ends of the upper support beam 41 are engaged with upper screw parts 17*a* and 17*a* of the right and left ball screws 17R and 17L, respectively.

Figure 3:
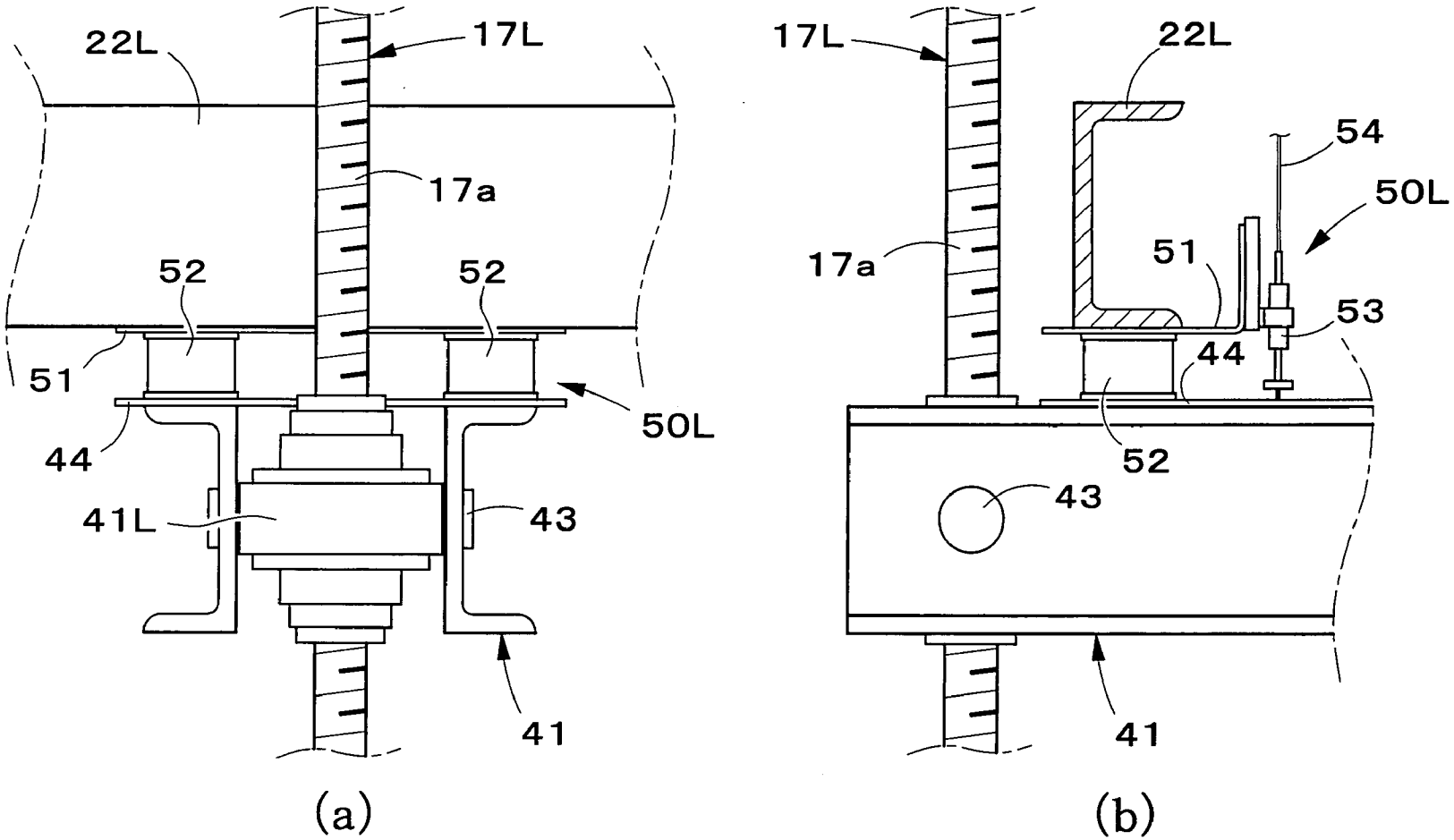
FIG. 3 is a side view from the direction of an arrow B and a side view from the direction of an arrow C shown in FIG. 2, respectively.

The upper support beam 41 is pivotably supported by the right and left screw nuts 41R and 41L by a shaft 43, as shown in FIG. 3.

Similarly, a lower support beam (a lower supporting member) 42 extending in the right-to-left direction is disposed above the lower cage 30 and below the right and left upper support arms 32R and 32L.

Right and left screw nuts 42R and 42L fitted to right and left ends of the lower support beam 42 are engaged with lower screw parts 17*b* and 17*b* of the right and left ball screws 17R and 17L, respectively.

The lower support beam 42 is pivotably supported by the right and left screw nuts 42R and 42L by the shaft 43, similarly to the upper support beam 41.

Therefore, when the right and left ball screws 17R and 17L are rotated in the forward direction, the upper support beam 41 is lowered, and the lower support beam is elevated.

On the other hand, when the right and left ball screws 17R and 17L are rotated in the reverse direction, the upper support beam 41 is elevated, and the lower support beam is lowered.

A left upper measuring unit 50L is interposed between the upper support beam 41 and the upper support arm 22L on the left side, and a right upper measuring unit 50R is interposed between the upper support beam 41 and the upper support arm 22R on the right side.

The upper support beam 41 thus hoists and supports the upper cage 20 via the right and left upper measuring units 50R and 50L and the right and left upper support arms 22R and 22L.

Similarly, a left lower measuring unit 60L is interposed between the lower support beam 42 and the lower support arm 32L on the left side, and a right lower measuring unit 60R is interposed between the lower support beam 42 and the lower support arm 32R on the right side.

The lower support beam 42 thus suspends and supports the lower cage 30 via the right and left lower measuring units 60R and 60L and the right and left lower support arms 32R and 32L.

Next, a description of the structure of the right and left upper measuring units 50R and 50L and the right and left lower measuring units 60R and 60L will be given with reference to FIG. 3.

Since the structure of these measuring units is identical, a description of the structure of the left upper measuring unit 50L will be given.

The left upper measuring unit 50L has a pair of forward and back elastic bodies 52 held in the vertical direction between a fitting plate 44 fixed on an upper face of the upper support beam 41 and a fitting plate 51 fixed on a lower side of the upper support arm 22L, as shown in FIG. 3.

These elastic bodies 52 elastically support the upper cage 20, and act as vibration isolating rubber members to improve the ride quality for passengers in the cage.

A differential transducer 53 as a sensor for measuring the deformation in the vertical direction of the pair of front and back elastic bodies 52, in other word, the space in the vertical direction between the upper support beam 41 and the upper support arm 22L, is disposed on a tip, which is folded in an L-shape, of the fitting plate 51 on the upper support arm 22L side at a position between the pair of front and back elastic bodies 52.

Signals output from the differential transducer 53 are transmitted to a controller 19 via wiring 54.

Figure 4:
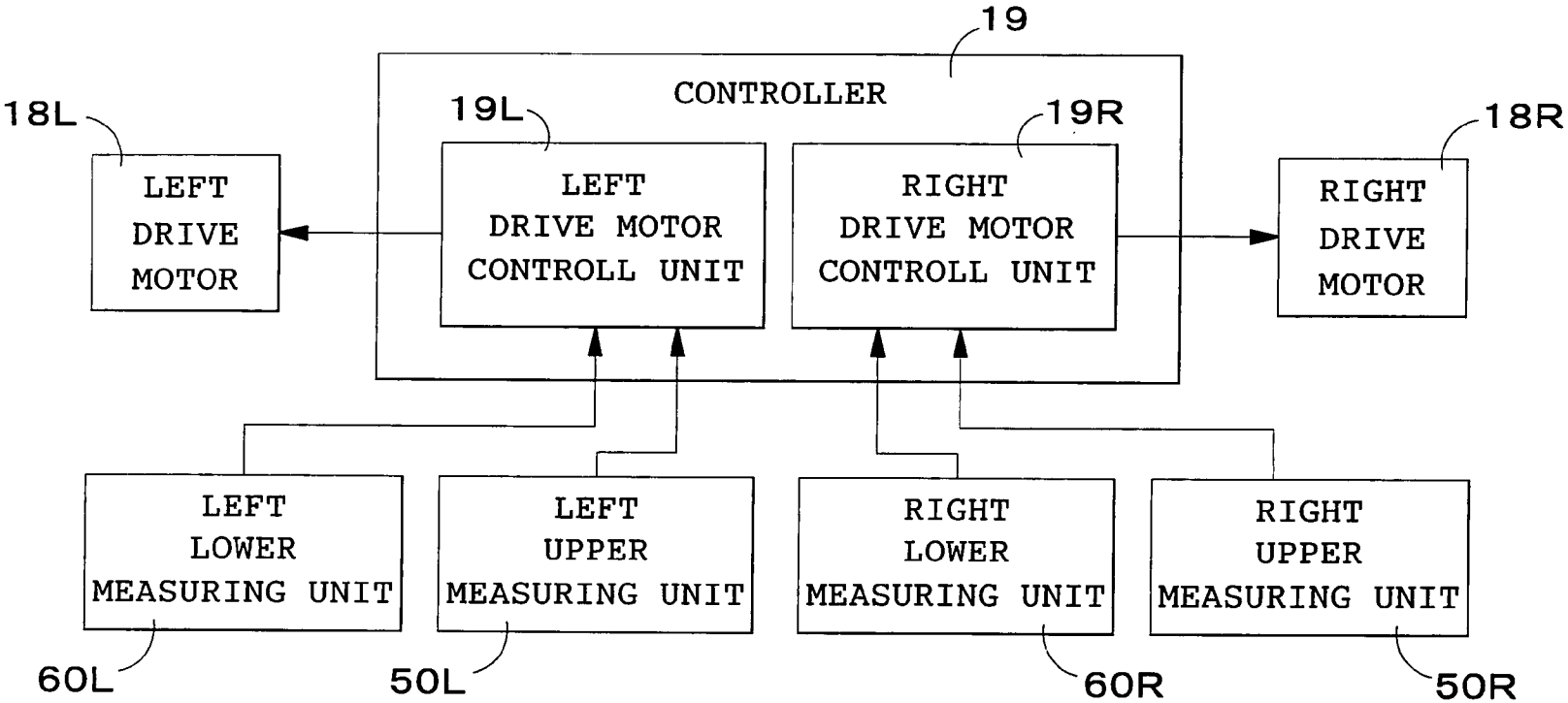
FIG. 4 is a block diagram showing the relationship between each measuring unit, a controller, and a drive motor.

The signal transmitted from the left upper measuring unit 50L is input to a left side drive motor control unit 19L of the controller 19, as shown in FIG. 4.

On the other hand, the signal transmitted from the right upper measuring unit 50R is input to a right side drive motor control unit 19R of the controller 19.

Similarly, the signal transmitted from the left lower measuring unit 60L is input to the left side drive motor control unit 19L of the controller 19, and the signal transmitted from the right lower measuring unit 60R is input to the right side drive motor control unit 19R of the controller 19.

The left side drive motor control unit 19L of the controller 19 calculates the load value on the upper support beam 41 from the left upper support arm 22L, and the load value on the lower support beam 42 from the left lower support arm 32L based on the deformation in the vertical direction of the elastic body 52 and the elastic constant of the elastic body 52, which are input from the left upper measuring unit 50L and the left lower measuring unit 60L.

Next, the left side drive motor control unit 19L of the controller 19 calculates the difference in each calculated load value, refers to a table stored in a storage unit (not shown), and obtains the direction and magnitude of the drive torque to be output by the left side drive motor 18L corresponding to the difference in the load values.

In this case, the direction and magnitude of the drive torque to be output by the left side drive motor 18L are the direction and magnitude of the drive torque to cancel a rotational biasing force applied to the left ball screw 17L attributable to the difference between the load applied to the left ball screw 17L from the left screw nut 41L of the upper support beam 41 and the load applied to the left ball screw 17L from the left screw nut 41L of the lower support beam 42.

The left side drive motor control unit 19L of the controller 19 controls its operation so that the left side drive motor 18L outputs this drive torque.

Similarly, the left side drive motor control unit 19R of the controller 19 calculates the load value on the upper support beam 41 from the right upper support arm 22R, and the load value on the lower support beam 42 from the right lower support arm 32R based on the deformation in the vertical direction of the elastic body 52 and the elastic constant of the elastic body 52, which are input from the right upper measuring unit 50R and the right lower measuring unit 60R.

Next, the left side drive motor control unit 19R of the controller 19 calculates the difference in each calculated load value, refers to a table stored in a storage unit (not shown), and obtains the direction and magnitude of the drive torque to be output by the right side drive motor 18R corresponding to the difference in the load values.

In this case, the direction and magnitude of the drive torque to be output by the right side drive motor 18R are the direction and magnitude of the drive torque to cancel a rotational biasing force applied to the right ball screw 17R attributable to the difference between the load applied to the right ball screw 17R from the right screw nut 41R of the upper support beam 41 and the load applied to the right ball screw 17R from the right screw nut 41R of the lower support beam 42.

The right side drive motor control unit 19R of the controller 19 controls its operation so that the right side drive motor 18R outputs this drive torque.

In this condition, the right and left upper support arms 22R and 22L are disposed in the vicinity of the right and left ball screws 17R and 17L, respectively.

Accordingly, the magnitude of the load on the upper support beam 41 from the left upper support arm 22L is equal to the magnitude of the load on the left ball screw 17L from the right screw nut 41L of the upper support beam 41.

Further, the magnitude of the load on the upper support beam 41 from the right upper support arm 22R is equal to the magnitude of the load on the right ball screw 17R from the right screw nut 41R of the upper support beam 41.

Similarly, the right and left lower support arms 32R and 32L are disposed in the vicinity of the right and left ball screws 17R and 17L, respectively.

Accordingly, the magnitude of the load on the lower support beam 42 from the left lower support arm 32L is equal to the magnitude of the load on the left ball screw 17L from the left screw nut 42L of the lower support beam 42.

Further, the magnitude of the load on the lower support beam 42 from the right lower support arm 32R is equal to the magnitude of the load on the right ball screw 17R from the right screw nut 42R of the lower support beam 42.

Thus, the left upper measuring unit 50L and the left lower measuring unit 60L can correctly measure the magnitude of the load on the left ball screw 17L from the upper support beam 41, and the magnitude of the load on the left ball screw 17L from the lower support beam 42, respectively.

Similarly, the right upper measuring unit 50R and the right lower measuring unit 60R can correctly measure the magnitude of the load on the right ball screw 17R from the upper support beam 41, and the magnitude of the load on the right ball screw 17R from the lower support beam 42, respectively.

The controller 19 can correctly control the operation based on the correctly measured load value as described above before adjusting the spacing in the vertical direction between the upper cage 20 and the lower cage 30, so that the left drive motor 18L outputs a drive torque with a direction and magnitude to cancel the rotational biasing force applied to the left ball screw 17L caused by the difference between the load on the left ball screw 17L from the upper support beam 41 and the load on the left ball screw 17L from the lower support beam 42.

Similarly, the controller 19 can correctly control the operation based on the correctly measured load value as described above before adjusting the spacing in the vertical direction between the upper cage 20 and the lower cage 30, so that the right drive motor 18R outputs a drive torque with a direction and magnitude to cancel the rotational biasing force applied to the right ball screw 17R caused by the difference between the load on the right ball screw 17R from the upper support beam 41 and the load on the right ball screw 17R from the lower support beam 42.

In other words, in the double-deck elevator 100 according to the present embodiment, the controller 19 can individually control the operation of the right and left drive motors 18R and 18L with very high accuracy.

Accordingly, even when the load on the right and left ball screws 17R and 17L is different because passengers are located unevenly, for example, on the left side of the cages 20 and 30, neither the right nor the left ball screws 17R and 17L is rotated as a result of the difference in weight between the cages 20 and 30 when a brake for stopping the rotation of the right and left ball screws 17R and 17L is released, and the spacing in the vertical direction between the cages 20 and 30 can be adjusted without causing any impacts or vibrations in the cages 20 or 30.

Next, some modifications of the double-deck elevator 100 of the present embodiment will be described with reference to FIGS. 5 to 8.

In the above embodiment, the upper support beam 41, the upper support arm 22L, and the differential transducer 53 for measuring the spacing in the vertical direction are used in order to measure the deformation in the vertical direction of the pair of front and back elastic bodies 52 interposed between the upper support beam 41 and the upper support arm 22L.

Figure 5:
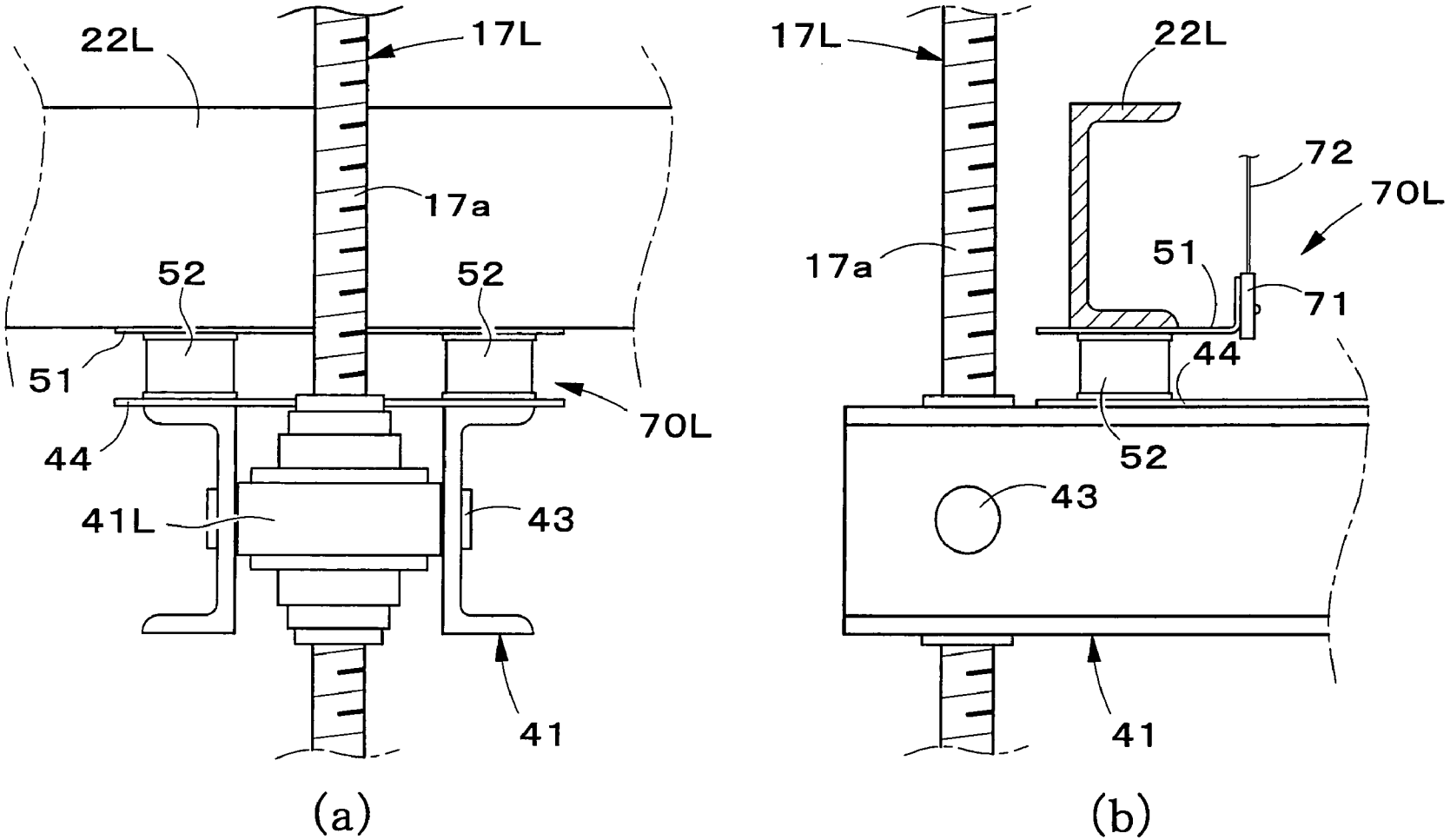
FIG. 5 is a side view, similar to FIG. 3, of a modification.

On the other hand, a non-contact displacement meter 71 using a beam such as an infrared ray is used in the left upper measuring unit 70L in the modification shown in FIG. 5.

Also, the output signal from the displacement meter 71 is transmitted to the controller 19 via wiring 72.

Figure 6:
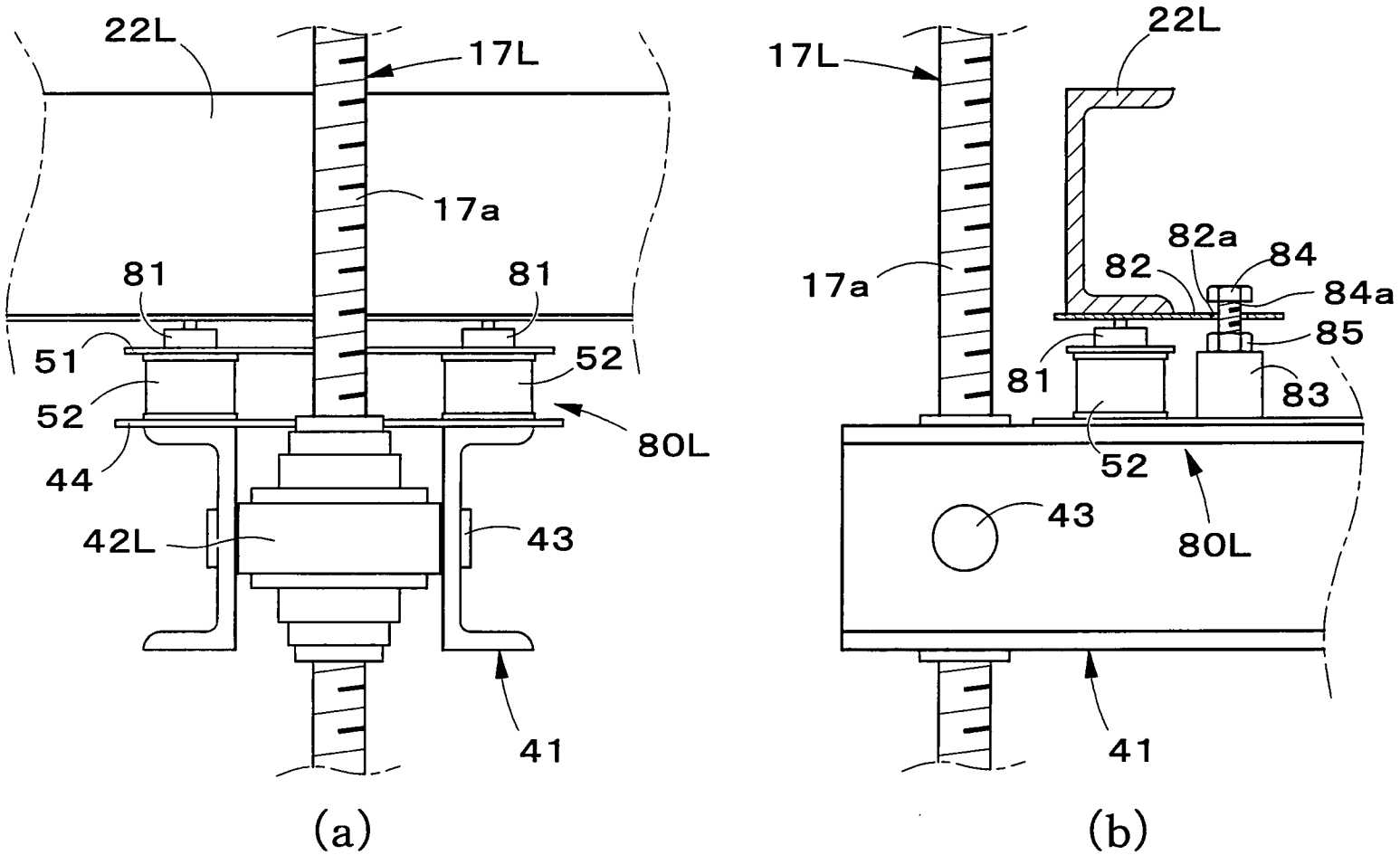
FIG. 6 is a side view similar to FIG. 3 of another modification.

In a left upper measuring unit 80L in the modification shown in FIG. 6, two front and back sets of the elastic body 52 and load cells 81, which are connected to each other in series, in other words, they overlap each other in the vertical direction, are interposed between the upper support beam 41 and the upper support arm 22L.

Accordingly, the magnitude of the load on the upper support beam 41 from the upper support arm 22L can be measured directly by the pair of front and back load cells 81.

In addition, the elastic bodies 52 are interposed between the upper support beam 41 and the upper support arm 22L, and the ride quality can be improved by elastically supporting the cages 20 and 30.

A bolt 85 which is engaged with a nut 83 fixed on the upper support beam 41 and locked by a lock nut 84 is passed in a through hole 82*a* in a supporting plate 82 fitted to a lower side of the upper support arm 22L, and prevents any excessive displacement in the depth and right-to-left directions of the upper support arm 22L with respect to the upper support beam 41.

Another double-deck elevator 200 of the present invention will be described with reference to FIG. 7.

Figure 7:
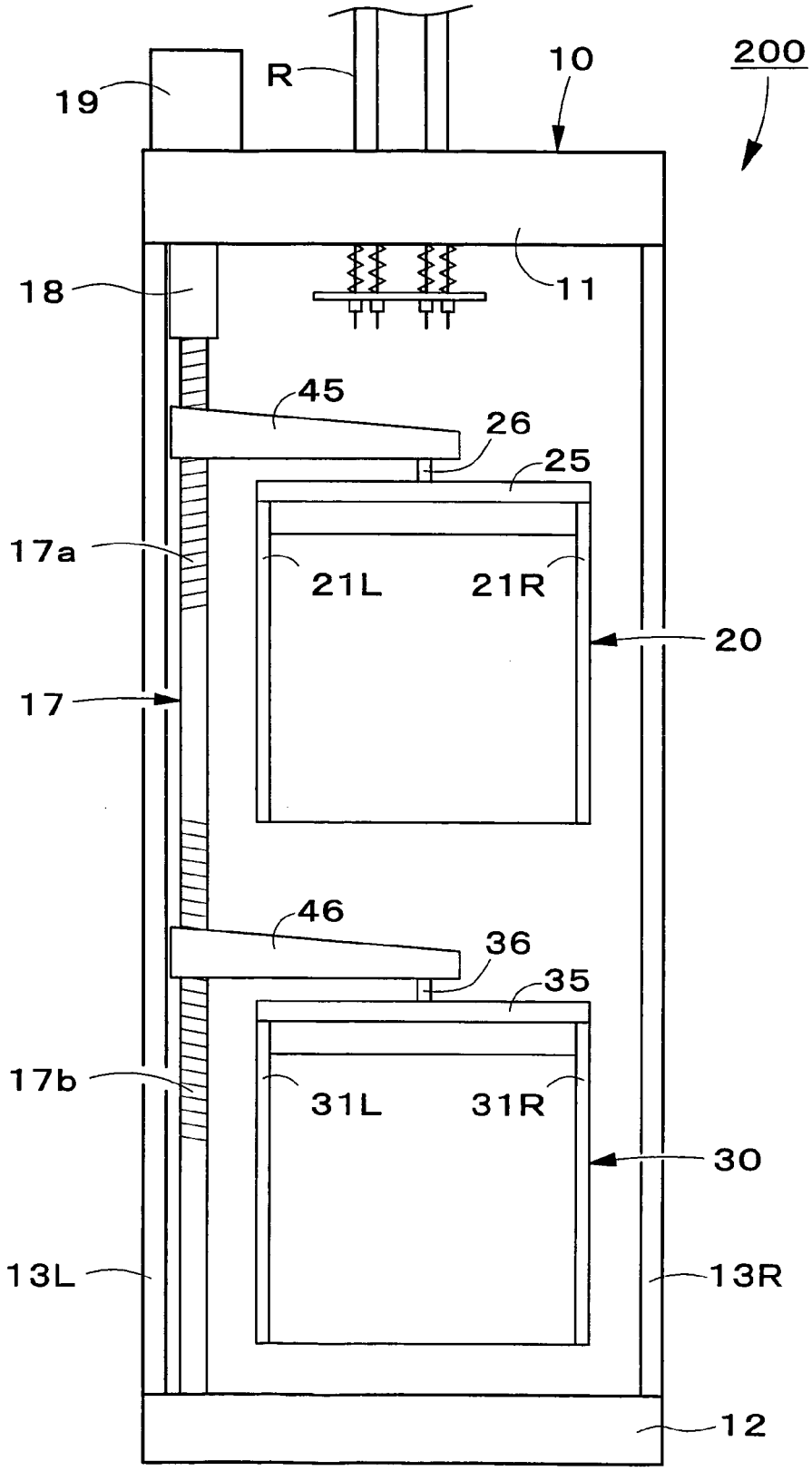
FIG. 7 is a schematic side view of a double-deck elevator of another embodiment.
Figure 8:
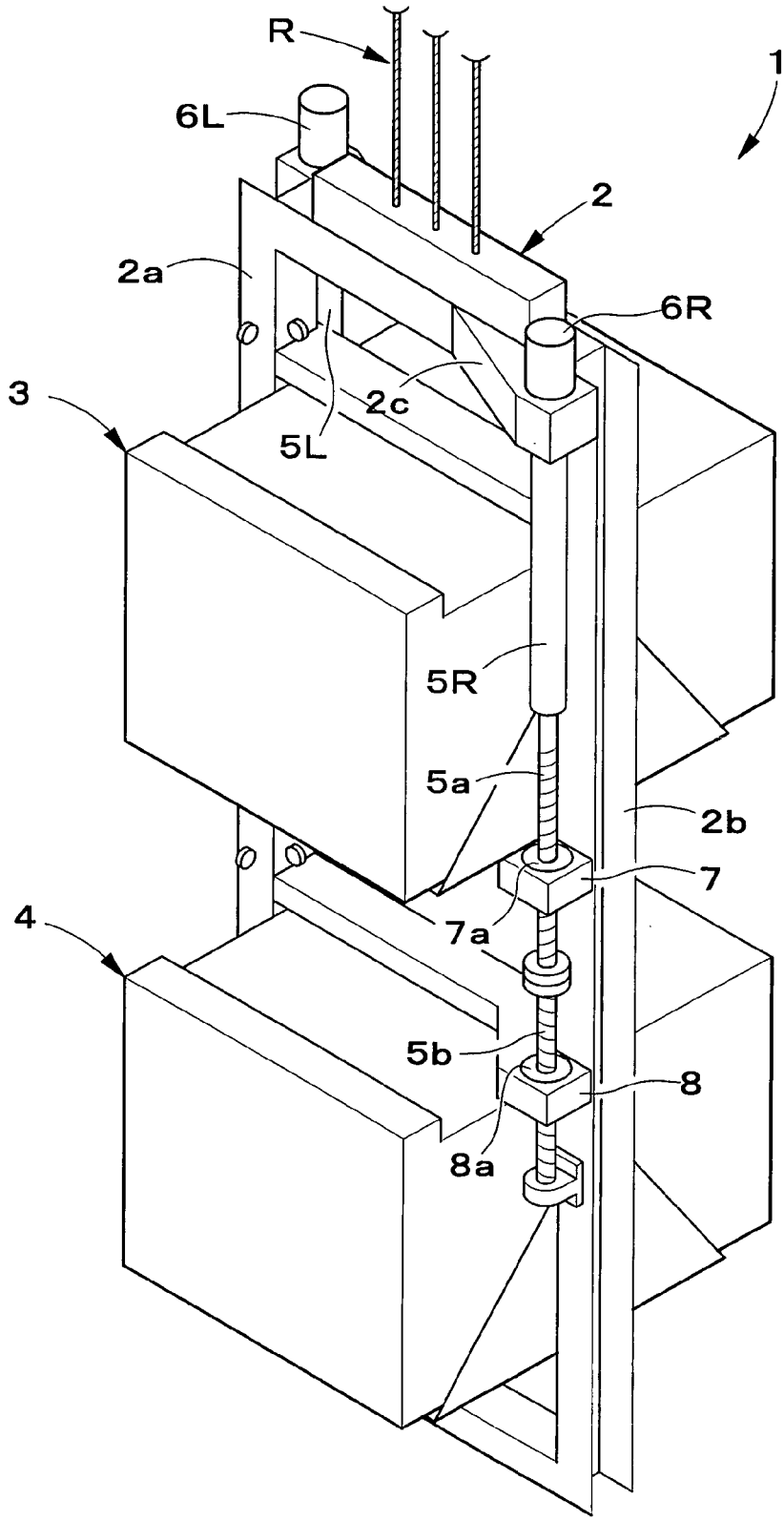
FIG. 8 is a perspective view of a conventional double-deck elevator.

In the double-deck elevator 200 shown in FIG. 7, an upper support beam 45 to hoist and support the upper cage 20, and a lower support beam 46 to hoist and support the upper cage 30 are constituted as cantilever beams.

Upper support arms 25 extending in an X-shape across each other at the center of the upper cage 20 in plan view are stretched over upper ends of frame members 21R and 21L extending in the vertical direction at four corners of the upper cage 20.

Further, an upper measuring unit 26 for measuring the weight of the upper cage 20 is interposed between a tip of the upper support beam 45 and the intersection of the upper support arms 25.

Similarly, lower support arms 35 extending in an X-shape across each other at the center of the lower cage 30 in plan view are stretched over upper ends of frame members 31R and 31L extending in the vertical direction at four corners of the lower cage 30.

Further, a lower measuring unit 36 for measuring the weight of the lower cage 23 is interposed between a tip of the lower support beam 46 and the intersection of the lower support arms 35.

Accordingly, the total weight of the upper cage 20 can be exclusively measured by one upper measuring unit 26, and the total weight of the lower cage 30 can be exclusively measured by one lower measuring unit 36, respectively, and thus, the weight of the upper cage 20 and the lower cage 30 can be measured correctly.

The controller 19 controls the operation based on the correctly measured weight of the upper cage 20 and the lower cage 30, as described above, before adjusting the spacing in the vertical direction between the upper cage 20 and the lower cage 30, so that the drive motor 18 outputs a drive torque with a direction and magnitude to cancel the rotational biasing force applied to the ball screw 17 attributable to the difference in weight between the upper cage 20 and the lower cage 30.

Accordingly, in the double-deck elevator 200, even when a brake for stopping the rotation of the ball screw 17 is released when adjusting the spacing in the vertical direction between the upper cage 20 and the lower cage 30, the ball screw 17 is not rotated by the difference in weight between the upper cage 20 and the lower cage 30, no impacts or vibrations are caused in the cages 20 or 30 when adjusting the spacing in the vertical direction between the upper cage 20 and the lower cage 30.

An embodiment of the double-deck elevator of the present invention, and modifications thereof are described above in detail: needless to say, the present invention is not limited to the above embodiments, but various kinds of modifications can be made.

For example, in the above embodiments, the elastic bodies 52 used in each measuring unit are compressed in the vertical direction by the weight of each cage; However, they may be disposed so as to be pulled in the vertical direction by the weight of each cage.

As described above, according to the double-deck elevator of the present invention, the weight of the upper and lower cages can be measured with high accuracy by hoisting and supporting each cage.

Accordingly, the difference in weight between the upper and lower cages can be obtained with high accuracy, and the operation of the screw shaft driving units used in adjusting the spacing in the vertical direction between the upper and lower cages can be controlled more correctly.

Therefore, according to the present invention, the operation of the screw shaft driving units can be controlled with high accuracy before adjusting the spacing in the vertical direction between the upper cage and the lower cage, so that the screw shaft driving units output a drive torque with a direction and magnitude to cancel the rotational biasing force applied to the screw shaft attributable to the difference in weight between the upper and lower cages, and the spacing in the vertical direction between the upper and lower cages can be adjusted without causing any impacts or vibrations in the upper or lower cages.

What is claimed is:

1. A double-deck elevator capable of adjusting the spacing in the vertical direction between upper and lower cages provided on a cage frame in a vertically movable manner, comprising:

a screw shaft rotatably supported by said cage frame and extending in the vertical direction;

screw shaft driving unit for rotating said screw shaft in the forward and reverse directions;

controllers for controlling the operation of said screw shaft driving units;

an upper supporting member which is engaged with an upper screw part of said screw shaft and vertically moved by the rotation of said screw shaft, and which hoists and supports said upper cage via one upper hoist-and-support part disposed on an upper part of said upper cage;

a lower supporting member which is engaged with a lower screw part threaded in a direction opposite to that of said upper screw part of said screw shaft and vertically moved by the rotation of said screw shaft, and which hoists and supports said lower cage via one lower hoist-and-support part disposed on an upper part of said lower cage;

an upper measuring unit which measures a load on said upper supporting member from said upper hoist-and-support part; and a lower measuring unit which measures a load on said lower supporting member from said lower hoist-and-support part, wherein said controllers control the operation of said screw shaft driving units based on the load value obtained by said upper measuring unit and the load value obtained from said lower measuring unit before adjusting the spacing in the vertical direction between said upper cage and said lower cage so that said screw shaft driving units output a drive torque with a direction and magnitude for canceling the rotational biasing force applied to said screw shaft attributable to the difference in weight between said upper cage and said lower cage.

2. A double-deck elevator according to claim 1, wherein said upper measuring unit and said lower measuring unit comprise elastic bodies interposed between said upper supporting member and said upper hoist-and-support part, and between said lower supporting member and said lower hoist-and-support part, and sensors for measuring the deformation in the vertical direction of said elastic bodies, and wherein said controllers respectively calculate said load value based on the elastic constant of said elastic bodies and the deformation obtained from said sensors.

3. A double-deck elevator according to claim 2, wherein said controllers adjust the spacing in the vertical direction between said upper cage and said lower cage based on the deformation in the vertical direction of said elastic bodies obtained from said sensors.

4. A double-deck elevator according to claim 1, wherein said upper measuring unit and said lower measuring unit are load cells interposed between said upper supporting member and said upper hoist-and-support part, and between said lower supporting member and said lower hoist-and-support part.

5. A double-deck elevator according to claim 4, wherein said load cells are disposed in series with elastic bodies between said upper supporting member and said upper hoist-and-support part, and between said lower supporting member and said lower hoist-and-support part.

6. A double-deck elevator capable of adjusting the spacing in the vertical direction between an upper cage and a lower cage which are provided on said cage frame in a vertically movable manner, comprising:

right and left screw shafts rotatably supported on right and left sides of said cage frame and extending in the vertical direction, respectively;

right and left screw shaft driving units for rotating said right and left screw shafts in the forward and reverse directions, respectively;

controllers for individually controlling the operation of said right and left screw shaft driving units;

an upper supporting member, which extends in the right-and-left direction above said upper cage, and is engaged with upper screw parts of said right and left screw shafts and vertically moved by said screw shafts;

a lower supporting member, which extends in the right-and-left direction above said lower cage, and is engaged with lower screw parts which are threaded in a direction opposite to that of said upper screw parts of said right and left screw shafts and vertically moved by said screw shafts;

right and left upper hoist-and-support parts which are disposed on the right and left sides of an upper part of said upper cage in the vicinity of said right and left screw shafts, and engaged with said upper supporting member respectively to hoist and support said upper cage;

right and left lower hoist-and-support parts which are disposed on the right and left sides of an upper part of said lower cage in the vicinity of said right and left screw shafts, and engaged with said lower supporting member respectively to hoist and support said lower cage;

right and left upper measuring units for measuring a load applied to said upper supporting member from said right and left upper hoist-and-support parts; and right and left lower measuring units for measuring a load applied to said lower supporting member from said right and left lower hoist-and-support parts, wherein said controllers control the operation of said left screw shaft driving unit based on the load value obtained from said left upper measuring unit and the load value obtained from said left lower measuring unit before adjusting the spacing in the vertical direction between said upper cage and said lower cage so that a drive torque with a direction and magnitude for canceling the rotational biasing force applied to said left screw shaft attributable to the difference between the load applied to said upper supporting member from said upper hoist-and-support part and the load applied to said lower supporting member from said left lower hoist-and-support part is output, and wherein said controllers control the operation of said right screw shaft driving unit based on the load value obtained from said right upper measuring unit and the load value obtained from said right lower measuring unit before adjusting the spacing in the vertical direction between said upper cage and said lower cage so that a drive torque with a direction and magnitude for canceling the rotational biasing force applied to said right screw shaft attributable to the difference between the load applied to said upper supporting member from said upper hoist-and-support part and the load applied to said lower supporting member from said right lower hoist-and-support part is output.

7. A double-deck elevator according to claim 6, wherein said upper measuring unit and said lower measuring unit comprise elastic bodies interposed between said upper supporting member and said upper hoist-and-support part, and between said lower supporting member and said lower hoist-and-support part, and sensors for measuring the deformation in the vertical direction of said elastic bodies, and wherein said controllers respectively calculate said load value based on the elastic constant of said elastic bodies and the deformation obtained from said sensors.

8. A double-deck elevator according to claim 7, wherein said controllers adjust the spacing in the vertical direction between said upper cage and said lower cage based on the deformation in the vertical direction of said elastic bodies obtained from said sensors.

9. A double-deck elevator according to claim 6, wherein said upper measuring unit and said lower measuring unit are load cells interposed between said upper supporting member and said upper hoist-and-support part, and between said lower supporting member and said lower hoist-and-support part.

10. A double-deck elevator according to claim 9, wherein said load cells are disposed in series with elastic bodies between said upper supporting member and said upper hoist-and-support part, and between said lower supporting member and said lower hoist-and-support part.

* * * * *